US009816297B2

(12) United States Patent
Perreau et al.

(10) Patent No.: US 9,816,297 B2
(45) Date of Patent: Nov. 14, 2017

(54) SECURITY DEVICE WITH MULTIPLE CONTROL STATES

(71) Applicant: Checkpoint Systems, Inc., Thorofare, NJ (US)

(72) Inventors: Benoit Perreau, Weddington, NC (US); David P. Christianson, Charlotte, NC (US); Donald Matthew Johnson, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 36 days.

(21) Appl. No.: 14/967,655

(22) Filed: Dec. 14, 2015

(65) Prior Publication Data

US 2017/0167166 A1 Jun. 15, 2017

(51) Int. Cl.

| | |
|---|---|
| ***E05B 73/00*** | (2006.01) |
| ***G08B 13/14*** | (2006.01) |
| ***E05B 45/06*** | (2006.01) |
| ***E05B 47/00*** | (2006.01) |
| ***E05B 49/00*** | (2006.01) |
| ***G07C 9/00*** | (2006.01) |
| ***G08B 13/24*** | (2006.01) |

(52) U.S. Cl.

CPC ..... *E05B 73/0029* (2013.01); *E05B 45/06* (2013.01); *E05B 47/0002* (2013.01); *E05B 49/00* (2013.01); *G07C 9/00817* (2013.01); *G08B 13/14* (2013.01); *G08B 13/1427* (2013.01); *G08B 13/246* (2013.01); *E05B 2045/069* (2013.01); *E05B 2045/0665* (2013.01); *E05B 2047/0067* (2013.01); *E05B 2047/0072* (2013.01)

(58) Field of Classification Search

CPC .... E05B 3/0029; E05B 45/06; E05B 47/0002; E05B 49/00; E05B 2045/0665; E05B 2047/0067; E05B 2047/0072; E05B 2045/069; E05B 47/0603; G07C 9/00817; G08B 13/246; G08B 13/22; G08B 13/1427; G08B 13/14; G06K 17/00; G06K 19/00

USPC ..... 340/5.25, 5.73, 572.9, 572.3, 568.2

See application file for complete search history.

(56) References Cited

U.S. PATENT DOCUMENTS

| | | | | |
|---|---|---|---|---|
| 7,242,304 | B2 * | 7/2007 | Clancy | G08B 13/246 235/380 |
| 7,737,845 | B2 * | 6/2010 | Fawcett | G07C 9/00309 340/5.25 |
| 8,122,744 | B2 | 2/2012 | Conti et al. | |
| 8,281,626 | B2 | 10/2012 | Conti et al. | |
| 8,599,022 | B2 | 12/2013 | Conti et al. | |
| 9,437,088 | B2 * | 9/2016 | Phillips | G08B 13/1427 |

(Continued)

*Primary Examiner* — Ali Neyzari

(74) *Attorney, Agent, or Firm* — McNair Law Firm, P.A.

(57) ABSTRACT

A security device is provided including a security lock configured to retain an object when locked, a receiver configured to receive a security code transmission, and processing circuitry configured to transition the security lock between a locked state and unlock permissive state based on receipt of a security code. The security lock may initially be set to the unlock permissive state. At the first instance in which a security code is received, the processing circuitry may transition the security lock to a key permissive mode in which the security lock transitions to a locked state and in response to a subsequent receipt of the security code the security lock transitions to the unlock permissive state.

9 Claims, 3 Drawing Sheets

(56) References Cited

U.S. PATENT DOCUMENTS

| | | | | |
|---|---|---|---|---|
| 9,659,472 | B2 * | 5/2017 | Fawcett | G08B 13/14 |
| 2005/0190060 | A1 | 9/2005 | Clancy et al. | |
| 2007/0131005 | A1 | 6/2007 | Clare | |
| 2010/0101283 | A1 | 4/2010 | Xiaobin | |
| 2016/0307417 | A1 * | 10/2016 | Van Landingham, Jr. | E05B 73/0029 |

* cited by examiner

SECURITY DEVICE WITH MULTIPLE CONTROL STATES

TECHNICAL FIELD

Example embodiments generally relate to security devices and, in particular, relate to a security device with multiple control states.

BACKGROUND

Typical security devices may be configured to open when presented with a proper key, such as a properly aligned magnetic field of a predetermined strength. Some security devices may be configured to open when presented with a security code. The security code may be received from a transmitter with a short transmission range, such as about 12 inches. In some instances security devices may be configured for both the keyed lock and a security code. In cases in which the security device has both the keyed lock and a security code, the receipt of the correct security code may transition the security device to an unlock permissive state in which the key may open the lock. However, the security device is typically programmed to require the security code prior to transitioning to the unlock permissive state. This may prevent or limit the versatility of the security device. For example, a security device configured with both the keyed lock and security code may not be desirable to stores or warehouses that work in high volume, since more steps are required to secure or remove the security device. Similarly, some customers may deem the additional expense of a security code transmitter to be unnecessary for their security concerns. This may cause a desire for separate security devices to be sold depending on the specific configurations and security concerns, which may result in two separate product lines being designed, manufactured and sold.

BRIEF SUMMARY OF SOME EXAMPLES

Accordingly, some example embodiments may enable a security device, as described below. In one example embodiment, a security device is provided including a security lock configured to retain an object when locked, a receiver configured to receive a security code transmission, and processing circuitry configured to transition the security lock between a locked state and unlock permissive state based on receipt of the security code. The security lock may be initially be set to the unlock permissive state. At the first instance in which the security code is received, the processing circuitry may transition the security lock to a key permissive mode in which the security lock transitions to a locked state and in response to a subsequent receipt of the security code the security lock transitions to the unlock permissive state.

In another example embodiment, a security system is provided including a security device including a security lock configured to retain an object when locked, a receiver configured to receive a security code transmission, and processing circuitry configured to transition the security lock between a locked state and unlock permissive state based on receipt of a security code. The security lock may be initially be set to the unlock permissive state. At the first instance in which a security code is received, the processing circuitry may transition the security lock to a key permissive mode in which the security lock transitions to a locked state and in response to a subsequent receipt of the security code the security lock transitions to the unlock permissive state. The security system may also include a release device configured to cause a transmission of the security code.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1A:
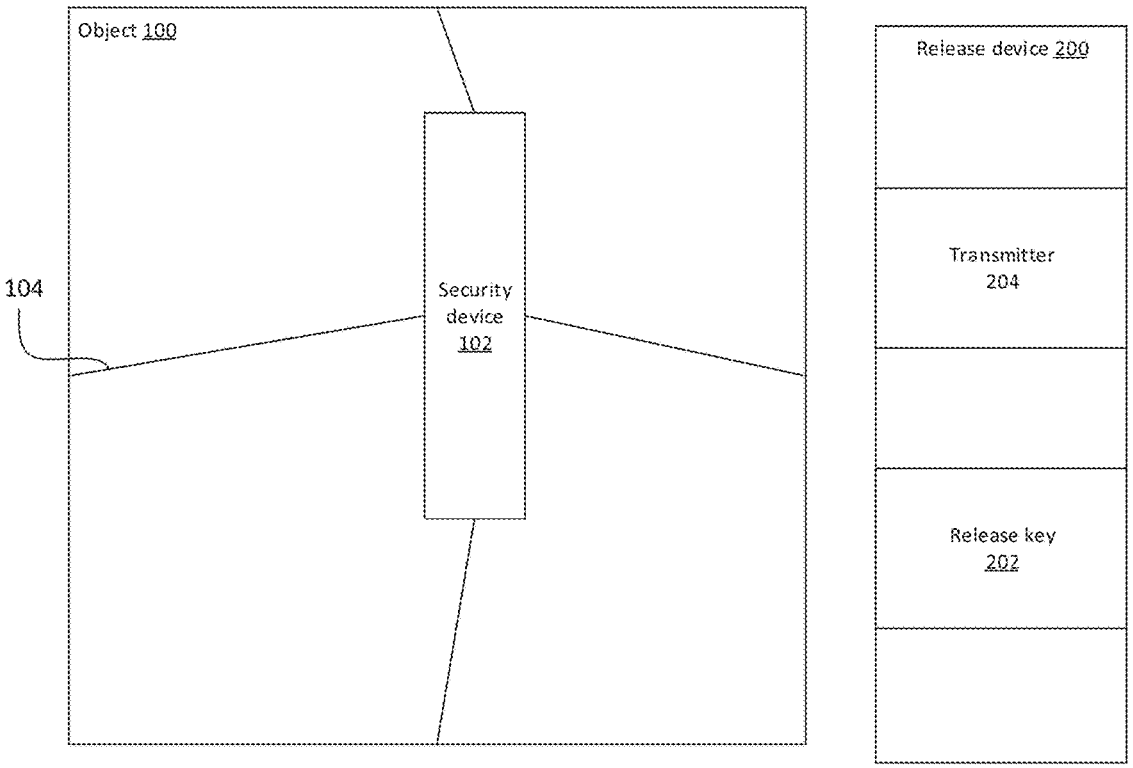
FIG. 1A illustrates an example security system according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

In some examples, a security device or security system may be provided which is configured to operate in a plurality of modes. The security device may include a security lock, such as a magnetic security lock, and processing circuitry configured to control the operation of the security lock. The security device may initially operate in an unlock permissive state, in which the lock may open when presented with the proper key, such as a magnet of the proper alignment and strength. For customers who desire a single step lock, the security device may continue operation in the unlock permissive state indefinitely. For customers who desire a two step lock, the security device may be configured to receive a security code from a release device. The security device may set the security code upon receipt, such as writing the security code to memory, and transition to a key permissive mode. In the key permissive mode the lock may be in a locked state, in which the security lock may not open, even when presented with the proper key. In response to receiving a subsequent security code, the security device may compare the received security code to the set security code and transition to an unlock permissive state in an instance in which the set security code matches the received security code. Since the security device can operate in a key only mode or the key permissive mode, a single security device may be manufactured and sold to a broad range of customers, reducing production costs and allowing customer to select the mode of the device and increase the security as desired, without necessitating the purchase of additional security devices.

In some embodiments, the transition to the unlock permissive state in key permissive mode may be for a predetermined period of time, such as 30 seconds, in which the security lock may be opened if the proper key is presented. In response to the expiration of the time period, the security lock may transition back to the locked state. The transition back to the locked state may prevent security devices which have transitioned to the unlock permissive state but are not removed, from remaining in the lower security state.

The security code may be transmitted in an audible frequency, such as 4 kHz. The use of an audible frequency carrier may reduce complexity and costs of the release device, since a speaker may be used to transmit the security code.

Figure 1B:
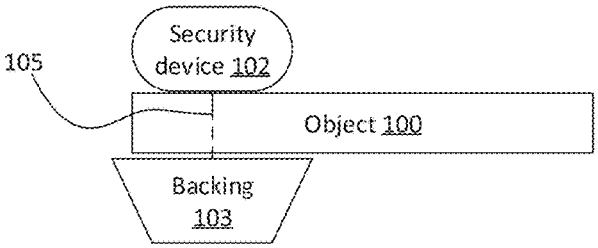
FIG. 1B illustrates and example security device according to an example embodiment.

FIG. 1A illustrates an example security system according to an example embodiment. The security system may include a security device 102 and a release device 200. The security device 102 may include a lanyard 104. The release device 200 may include a release key 202 and a transmitter 204. The security device 102 may be attached to an object 100, such as a product or package, for security tracking and/or loss prevention. The security device 102 may be attached to the object 100 by wrapping a lanyard 104 around the object 100 and locking the security device 102. In some embodiments, the lanyard 104 may be tightened around the object 100 after the security device 102 has been locked, such as by a tightening knob, crank, tension spring, or the like. In an example embodiment, the security device 102 may include a pin 105 and backing 103 and the security device may lock the pin through the object 100, as depicted in FIG. 1B.

The security device 102 may perform one or more security functions, such as alarming in an instance in which the lanyard 104 is removed, cut, or damaged without unlocking the security device 102; transmitting a beacon signal or location data for location tracking; indicating passage through a magnetic or radio frequency (RF) receiving or transmitting field, such as security gates; or the like.

The release device 200 may include a release key 202 configured to open a security lock associated with the security device 102. The release key 202 may be a physically operated key, such as a magnetic key including one or more magnets; a tube key, cylinder key, or other type of physically operated key. In some embodiments, the release key 202 may be an input to a security program which unlocks the security lock of the security device 102, for example a magnetic key, biometric data, microchip identification, or the like.

The transmitter 204 may be an infrared transmitter, transmitting at 30-60 kHz, an audio transmitter, such as a speaker, transmitting at 20 Hz-20 kHz, an RF transmitter transmitting at 8.2 MHz, or the like. In an example embodiment, the transmitter transmits at about 4 kHz. The transmitter 204 may be configured to transmit a security code, e.g. a series of symbols, such as a binary code, decimal code, hexadecimal code, alphanumeric code, character code, or the like.

The operation of the security device 102 is discussed below in reference to FIGS. 2 and 3 below.

Figure 2:
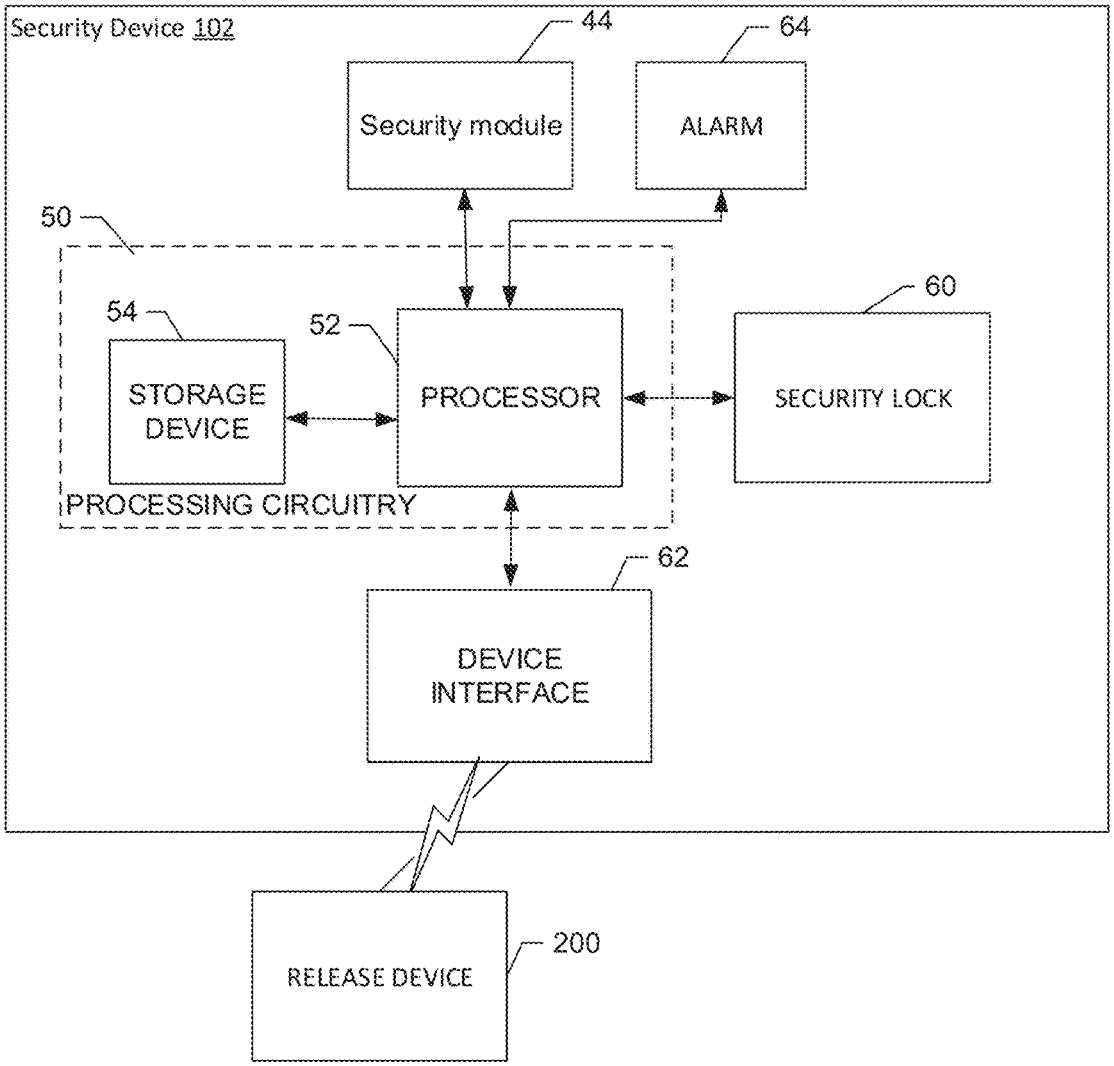
FIG. 2 illustrates a block diagram of the security system according to an example embodiment.

FIG. 2 illustrates a block diagram of the security system according to an example embodiment. The security system may include the security device 102 and the release device 200. The security device 102 may include processing circuitry 50, a security module 44, an alarm 64, a security lock 60, and a device interface 62.

In one embodiment, the processing circuitry 50 may include a storage device 54 and a processor 52 that may be in communication with or otherwise control security lock 60, a device interface 62, and alarm 64, or the like. As such, the processing circuitry 50 may be embodied as a circuit chip (e.g., an integrated circuit chip) configured (e.g., with hardware, software or a combination of hardware and software) to perform operations described herein.

In an example embodiment, the storage device 54 may include one or more non-transitory storage or memory devices such as, for example, volatile and/or non-volatile memory that may be either fixed or removable. The storage device 54 may be configured to store information, data, applications, instructions or the like for enabling the apparatus to carry out various functions in accordance with some example embodiments. For example, the storage device 54 could be configured to buffer input data for processing by the processor 52. Additionally or alternatively, the storage device 54 could be configured to store instructions for execution by the processor 52.

The processor 52 may be embodied in a number of different ways. For example, the processor 52 may be embodied as various processing means such as a microprocessor or other processing element, a coprocessor, a controller or various other computing or processing devices including integrated circuits such as, for example, an ASIC (application specific integrated circuit), an FPGA (field programmable gate array), a hardware accelerator, or the like. In an example embodiment, the processor 52 may be configured to execute instructions stored in the storage device 54 or otherwise accessible to the processor 52. As such, whether configured by hardware or software methods, or by a combination thereof, the processor 52 may represent an entity (e.g. physically embodied in circuitry) capable of performing operations according to example embodiments while configured accordingly. Thus, for example, when the processor 52 is embodied as an ASIC, FPGA or the like, the processor 52 may be specifically configured hardware for conducting the operations described herein. Alternatively, as another example, when the processor 52 is embodied as an executor of software instructions, the instructions may specifically configure the processor 52 to perform the operations described herein.

The security lock 60 may include a locking device configured to secure the lanyard 104. In an example embodiment, the security lock 60 may secure the pin 105 through the object 100 with the locking backing 103. The security lock 60 may be a magnetic lock, a cylinder lock, a tubular lock, tube lock, biometric lock, or the like. The processing circuitry 50 may control a permissive element in the lock, such as a solenoid which prevents operation of the lock. In this regard, for example, an electro-mechanical actuator may be included that may be actuated into a locked or unlocked position in response to the security device 102 receiving a respective signal. In an instance in which the permissive element is in a permissive position the lock may be opened by the release key 202. In an instance in which the permissive element is in a secure position the lock may not open when the release key 202 is used on the security lock 60.

The device interface 62 may include one or more interface mechanisms for enabling communication with other devices, such as security gates, the release device 200, or the like. The device interface 62 may include a sensor, such as an audio sensor, infrared sensor, RF sensor or the like configured to receive transmissions from the release device 200. The device interface 62 may include a transmitter, such as a RF transmitter, to transmit a beacon signal or location data for location tracking, or a security pulse configured to be detected by a security gate.

The alarm 64 may be configured to generate sound, light, or the like, to attract attention to the location of the security device 102. The alarm 64 may include a speaker and/or lights. The processing circuitry 50 may be configured to cause the alarm 64 to sound and/or illuminate in an instance in which the lanyard 104 is removed, cut, or damaged, or the backing 103 removed from the pin 105, without unlocking the security lock 60. Additionally or alternatively, the processing circuitry 50 may be configured to cause the alarm 64 to sound or illuminate in an instance in which the security device 102 detects passage through a security gate. In an example embodiment, the alarm 64 may trigger a remote alarm, e.g. a store alarm, such as by causing the transmission of a trigger signal using the device interface 62.

In an example embodiment, the security module 44 may be configured for causing the transition between an unlock permissive state and a locked state. The security lock 60 may be initially be set to the unlock permissive state. At the first instance in which a security code is received, the processing circuitry 50 may transition the security lock 60 to a key permissive mode in which the security lock transitions to a locked state; and in response to a subsequent receipt of the security code the security lock transitions to the unlock permissive state.

In some embodiments, the security module 44 may further include one or more components or modules that may be individually configured to perform one or more of the individual tasks or functions generally attributable to the security module 44. However, the security module 44 need not necessarily be modular. In cases where the selection security module 44 employs modules, the modules may, for example, be configured for transitioning the security lock 60 between the unlock permissive state and the locked state, as described herein. In some embodiments, the security module 44 and/or any modules comprising the security module 44 may be any means such as a device or circuitry operating in accordance with software or otherwise embodied in hardware or a combination of hardware and software (e.g., processor 52 operating under software control, the processor 52 embodied as an ASIC or FPGA specifically configured to perform the operations described herein, or a combination thereof) thereby configuring the device or circuitry to perform the corresponding functions of the security module 44 and/or any modules thereof, as described herein.

Figure 3:
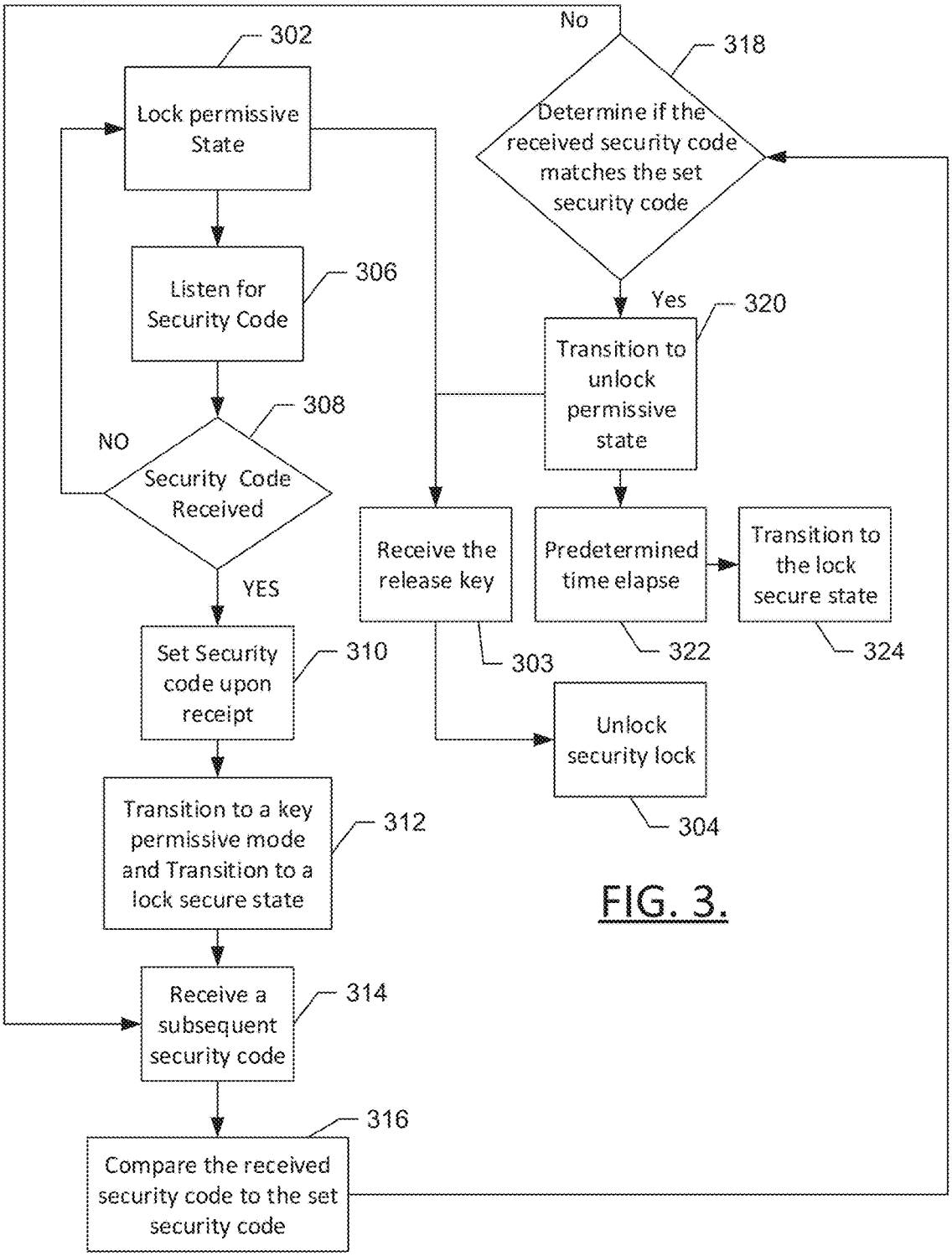
FIG. 3 illustrates an example flowchart of the operations of the security system according to an example embodiment.

FIG. 3 illustrates an example flowchart of the operations of the security system according to an example embodiment. The security module 44 described above may be used to support some or all of the operations described below. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device of the security device 102.

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

At operation 302, the security device 102 may initially be in a key only mode including an unlock permissive state. In the unlock permissive state, the security lock 60 may be locked and unlocked by the release key 202. The release key 202 may be received by the security device at operation 303 unlocking the security lock 60, at operation 304. In some example embodiments, a permissive element of the security lock 60 may be in the permissive position which may allow operation of the security lock 60.

The device interface 62 may listen for a security code, at operation 306, and determine if a security code is received at operation 308. In an instance in which a security code is not received, such as from the release device 200, the security device 102 may continue operation in the unlock permissive state at operation 302. In an instance in which the device interface 62 does receive a security code the process may continue at operation 310.

At operation 310, the security device 102 may set the security code. In an example embodiment, setting the security code may include writing the security code to a memory, such as storage device 54.

In response to receiving and setting the security code, at operation 312, the processing circuitry 50 may cause the security lock 60 to transition to a key permissive mode. In an example embodiment, the processing circuitry 50 may cause the security lock 60 to transition to a locked state. In some example embodiments, the permissive element of the security lock 60 may transition to a secure position, preventing operation of the security lock 60.

At operation 314, the device interface 62 may receive a subsequent security code, such as from the release device 200. The processing circuitry 50 may retrieve the set security code from the memory and compare the set or stored security code to the received security code, at operation 316.

At operation 318, the security device 102 processing circuitry 50 may determine if the received security code matches the set security code. In an instance in which the set security code does not match the received security code, the security lock may continue operation in the locked state and the process may continue at operation 314 at a subsequent receipt of a security code. In an instance in which the set security code matches the received security code, the process may continue at operation 320.

At operation 320, the processing circuitry 50 may cause the security lock 60 to transition to the unlock permissive state. In an example embodiment, the permissive element of the security lock 60 may be positioned to the permissive position, in an instance in which the security lock 60 transitions to the unlock permissive state. The security lock may be unlocked utilizing the release key 202 of the release device 200, at operation 304.

Alternatively, in an instance in which the security lock 60 is not opened within a predetermined period of time, e.g. the predetermined period of time elapses, at operation 322, the processing circuitry 50 may cause the security lock 60 to transition to the lock secure state at 324. In an example embodiment, the predetermined period of time may be 20 seconds, 30, seconds, 60 seconds, or the like.

In some embodiments, the security system may be further configured for optional modifications. In this regard, in an example embodiment of the security system the transition to the unlock permissive state in response to the subsequent security code receipt is for a predetermined period of time and the security device transmissions to the locked state in response to the expiration of the predetermined period of time. In an example embodiment, the predetermined period of time is about 30 seconds to about 60 seconds. In some example embodiments, the security code is on an audible frequency band. In an example embodiment, the security code is on a frequency band of about 4 kHz. In some example embodiment, the security lock is a magnetic security lock. In an example embodiment, the security lock further comprises a lanyard configured to encompass at least a portion of the object. In some example embodiments, the security device also includes an alarm configured to actuate in response to removal of the security device without unlocking the security lock. In an example embodiment, the processing circuitry is configured to store the security code to a memory at the first instance in which the security code is received, compare any received security code to the security code stored in memory, and the transition from the locked state to the unlock permissive state is in response to the received security code matching the security code stored in memory. In some example embodiments, the release device is further configured to unlock the security lock when the security lock is in the unlock permissive state. In an example embodiment, the security lock is a magnetic lock.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A security device comprising:

a security lock configured to retain an object when locked;

a receiver configured to receive a security code transmission; and processing circuitry configured to transition the security lock between a locked state and an unlock permissive state based on receipt of the security code;

wherein the security lock is initially set to the unlock permissive state;

wherein at a first instance in which the security code is received, the processing circuitry transitions the security lock to a key permissive mode and the security lock transitions to a locked state; and wherein in response to a subsequent receipt of the security code the security lock transitions to the unlock permissive state.

2. The security device of claim 1, wherein the security lock is configured to, in response to the subsequent security code receipt, remain in the unlock permissive state for a predetermined period of time, and wherein the security lock is configured to transition to the locked state in response to an expiration of the predetermined period of time.

3. The security device of claim 1, wherein the security code is transmitted on a frequency in an audible frequency band.

4. The security device of claim 1, wherein the security code is transmitted on a frequency in a frequency band including 4 kHz.

5. The security device of claim 1, wherein the security lock comprises a magnetic security lock.

6. The security device of claim 1, wherein the security lock further comprises a lanyard configured to encompass at least a portion of the object.

7. The security device of claim 1 further comprising:

an alarm configured to occur in response to removal of the security device without unlocking the security lock.

8. The security device of claim 1, wherein the processing circuitry is configured to:

store the security code to a memory at the first instance in which the security code is received; and compare a received security code to the security code stored in the memory;

wherein the transition from the locked state to the unlock permissive state is in response to the received security code matching the security code stored in memory.

9. The security device of claim 1, wherein the security lock is a tube lock.

* * * * *